US010645487B2

(12) United States Patent
Cole

(10) Patent No.: US 10,645,487 B2
(45) Date of Patent: May 5, 2020

(54) VERTICALLY CONFIGURED PARAMETRIC TRANSDUCER HEADPHONES

(71) Applicant: Jason Everett Cole, Harper Woods, MI (US)

(72) Inventor: Jason Everett Cole, Harper Woods, MI (US)

(73) Assignee: Warped Dynamics, LLC, Detroit, MI (US)

( * ) Notice: Subject to any disclaimer, the term of this patent is extended or adjusted under 35 U.S.C. 154(b) by 90 days.

(21) Appl. No.: 15/998,250

(22) Filed: Jul. 23, 2018

(65) Prior Publication Data

US 2020/0029151 A1 Jan. 23, 2020

(51) Int. Cl.
*H04R 1/34* (2006.01)
*H04R 1/10* (2006.01)
*H04R 17/00* (2006.01)

(52) U.S. Cl.
CPC ..... *H04R 1/34* (2013.01); *H04R 1/1008* (2013.01); *H04R 17/00* (2013.01); *H04R 2217/03* (2013.01)

(58) Field of Classification Search
CPC ..... H04R 1/34; H04R 1/1008; H04R 17/00; H04R 2217/03
USPC ..... 381/74
See application file for complete search history.

(56) References Cited

U.S. PATENT DOCUMENTS 8,000,486 B2 * 8/2011 Hildebrandt ..... H04R 1/1075 381/309
8,750,541 B1 * 6/2014 Dong ..... H04R 3/12 381/182
10,231,054 B2 * 3/2019 Kaetel ..... H04R 5/02
2003/0035552 A1 * 2/2003 Kolano ..... G10K 11/28 381/77
2012/0219165 A1 * 8/2012 Yamada ..... H04R 1/1091 381/310
2013/0066636 A1 * 3/2013 Singhal ..... H04R 1/32 704/275
2014/0023206 A1 * 1/2014 Takayasu ..... H04R 1/403 381/97
2014/0307898 A1 * 10/2014 Norris ..... H04R 5/033 381/309
2015/0334485 A1 * 11/2015 Tyagi ..... H01B 11/22 381/74
2016/0050487 A1 * 2/2016 Kim ..... H04R 1/323 381/74
2016/0057525 A1 * 2/2016 Kappus ..... H04R 1/00 381/74
2016/0057529 A1 * 2/2016 Kappus ..... H04R 1/1075 381/74
2016/0073200 A1 * 3/2016 Yoo ..... H04R 5/0335 381/311
2016/0205459 A1 * 7/2016 Kamada ..... H04R 1/1041 381/74
2017/0353793 A1 * 12/2017 Sun ..... H04R 1/1083

* cited by examiner

*Primary Examiner* — David L Ton

(57) ABSTRACT

This invention is a new design for a directional headphone system that separates the speakers a distance away from the user ears. The speakers can be placed either pointed vertically or horizontally away from the ear. The sound is emitted and reflected and bounced back into the user's ears to eliminate the need for ear plugins or ear pads that can be hot and sweaty and uncomfortable with prolong use. The directional audio headphone eliminates the need for earpads on the ear or earbuds in the ear.

1 Claim, 7 Drawing Sheets

Perspective view

Perspective view

VERTICALLY CONFIGURED PARAMETRIC TRANSDUCER HEADPHONES

CROSS-REFERENCE TO RELATED APPLICATIONS

Figure 1:
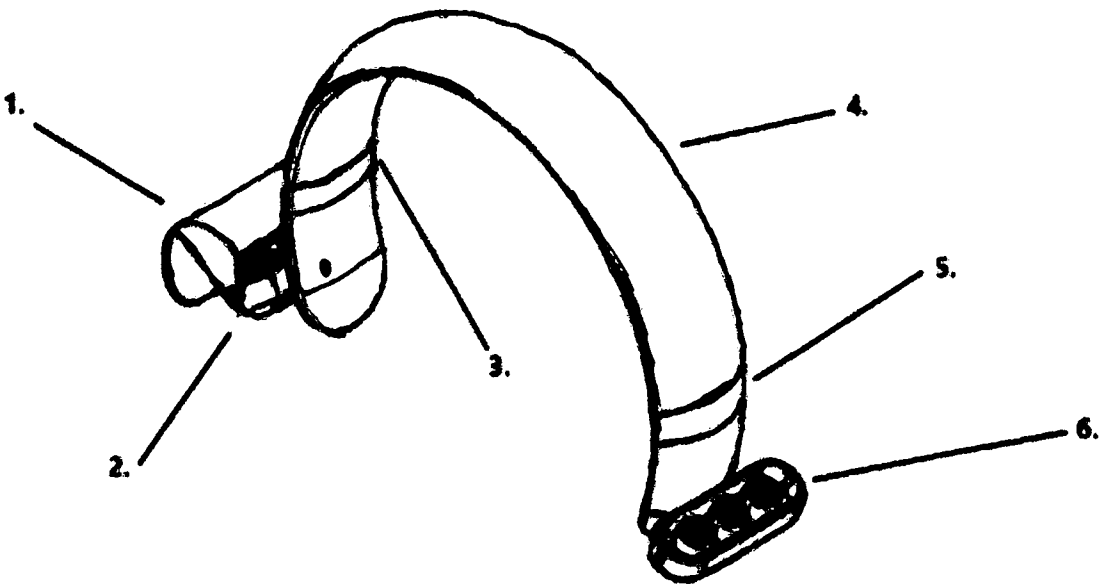

This application claims initial filing date of provisional application 62/710,945

The title of the provisional application:

Vertically configured parametric transducer headphone

STATEMENT REGARDING FEDERALLY SPONSORED RESEARCH OR DEVELOPMENT

There is no federally sponsored research or development.

THE NAMES OF THE PARTIES OF A JOINT RESEARCH AGREEMENT

There is no joint research agreement.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

There is no incorporation-by-reference of material submitted.

STATEMENT REGARDING PRIOR DISCLOSURES BY THE INVENTOR OR A JOINT INVENTOR

There is no prior disclosure by the inventor.

BACKGROUND OF THE INVENTION

The problem with current earpad and earbud headphones is that they can become too hot and sweaty or irritating inside the ear with prolong use. Over a prolong period such as watching a movie the headband can be compressive on the head and cause discomfort. The earpads can become hot and sweaty. In which the headband is very compressive. Earbuds can be irritating were someone is in the ear and cause discomfort. Besides earpads and earbuds the other personal audio technology are bone conducting headphones. The sound quality is isn't as good as earbuds and earpads and they give a weird vibrating sensation that may make the user feel uncomfortable with prolong use.

My new headphone design beams audio away from the ear and reflect and focus private audio into the ear. The benefit of the design is that it eliminates the need for hot and sweaty earpad headphones or intrusive irritating earbuds or vibrating bone conducting headphones. The user can enjoy private audio with far more comfort compared to earpad headphones, earbuds or bone conducting headphones.

FIELD OF THE INVENTION

The invention falls under personal audio headphone technology. Headphones traditionally refer to a pair of small loudspeaker drivers worn on or around the head over a user's ears. They are electroacoustic transducers, which convert an electrical signal to a corresponding sound. Headphones let a single user listen to an audio source privately, in contrast to a loudspeaker, which emits sound into the open air for anyone nearby to hear. Headphones are also known as ear speakers, earphones or, colloquially, cans. Circumaural ('around the ear') and supra-aural ('over the ear') headphones use a band over the top of the head to hold the speakers in place. Another type, known as earbuds or earpieces consist of individual units that plug into the user's ear canal. A third type headphones are bone conduction headphones, which typically wrap around the back of the head and rest near the temple in front of the ear canal, leaving the ear canal open. Audio is transmitted to user of the bone conduction headset via vibrations to the Cochlea.

DESCRIPTION OF RELATED ART INCLUDING INFORMATION DISCLOSED UNDER 37 CFR 1.97 AND 1.98

There is a Patent application called Parametric transducer headphones. It has a US patent application number Publication of US20160057529A1 with a priority to U.S. Ser. No. 14/464,178. The patent was never granted and application status of 2019 2019-07-04 is Abandoned. The headphone design pointed ultrasound directly into the ears, millimeters away through the air. That design appears to be uncomfortable and unsafe while my headphone design points the ultrasound away into attached reflectors so the sound can reflect and focus to the user's ears.

BRIEF SUMMARY OF THE INVENTION

The headphones consist of directional audio speakers placed on a headband. The novelty is to point the headphone speakers away from the ears and then have reflectors (one mounted to each speaker) and bounce and focus the sound back into the ears for private audio listening. The result is private audio without the discomfort of having hot, sweaty and compressive earpads on the ear or irritating and intrusive earbuds in the ear for private audio listening.

BRIEF DESCRIPTION OF THE SEVERAL VIEWS OF THE DRAWING(S)

FIG. 1 show a perspective view of the Planar array headphone design.

Figure 2:
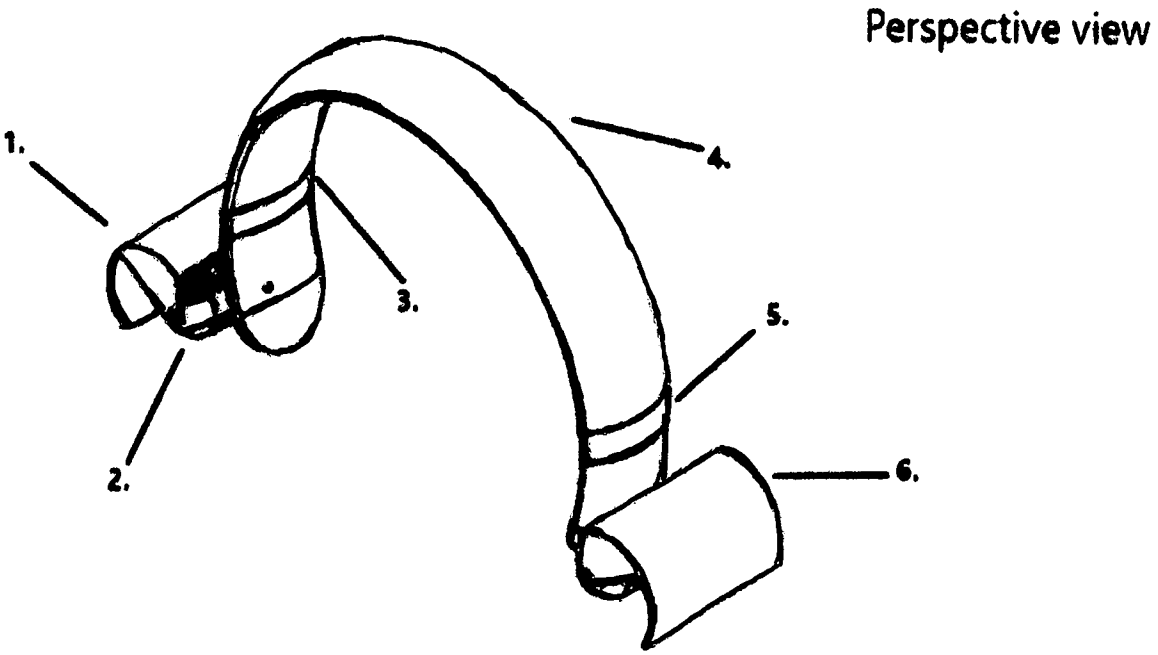

1. Acoustic reflector
2. Parametric speakers
3. Headband stretching mechanism
4. Headband
5. Headband stretching mechanism
6. Parametric speaker FIG. 2 show a perspective view of the Planar array headphone design.

Figure 3:
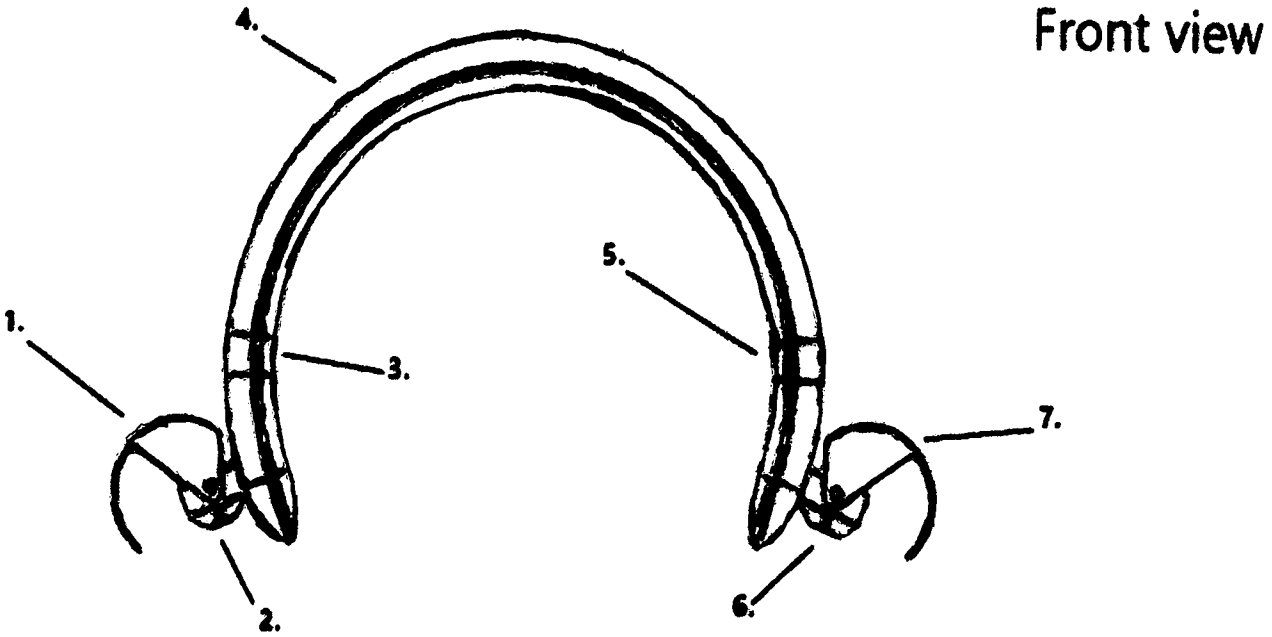

1. Acoustic reflector
2. Parametric speaker
3. Headband stretching mechanism
4. Headband
5. Headband stretching mechanism
6. Acrylic reflector FIG. 3 show a front view of the Planar array headphone design.

Figure 4:
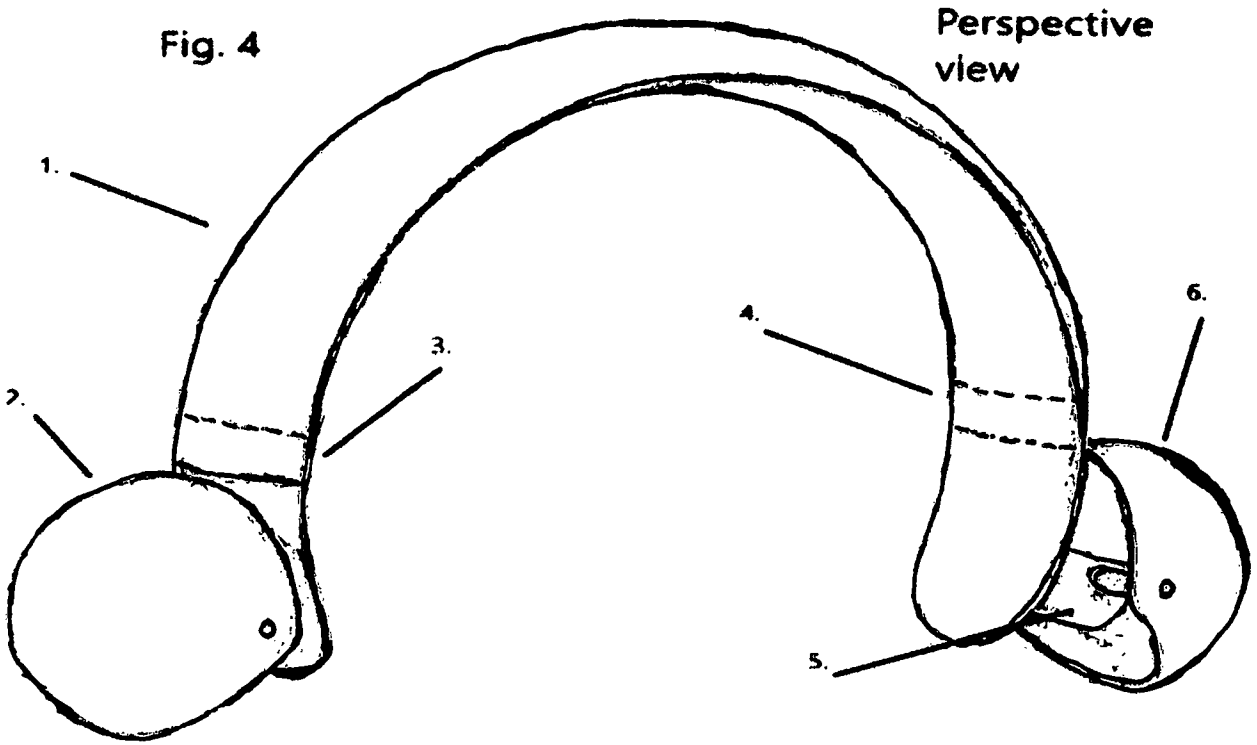

1. Acrylic reflector
2. Parametric speaker
3. Headband stretching mechanism
4. Headband
5. Headband stretching mechanism
6. Parametric speaker
7. Acrylic reflector FIG. 4 show a perspective view of the mini sound dome headphone design.

Figure 5:
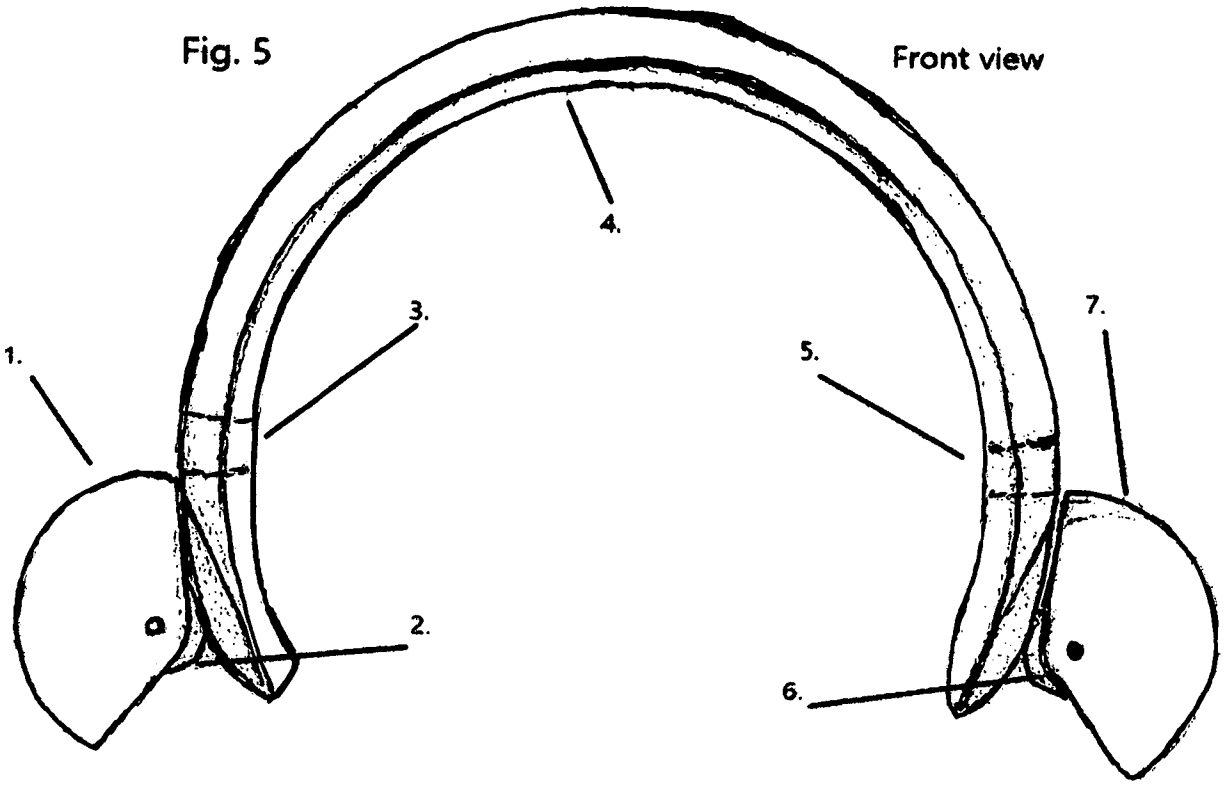

1. Headband
2. Acoustic reflector
3. Headband stretching mechanism
4. Headband stretching mechanism
5. Speaker
6. Acoustic reflector FIG. 5 show a front view of the mini sound dome headphone design.

Figure 6:
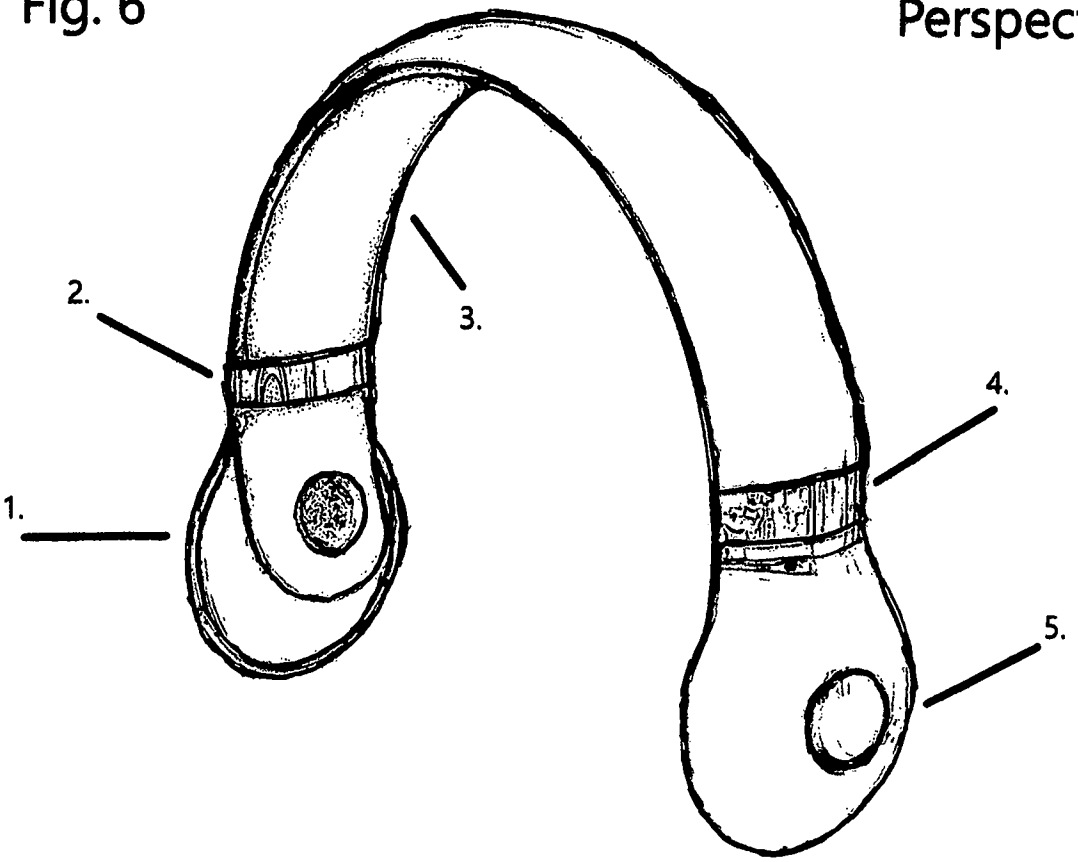

1. Acoustic reflector
2. Speaker
3. Headband stretching mechanism
4. Headband
5. Headband stretching mechanism
6. Speaker
7. Acoustic reflector FIG. 6 show a perspective view of the parabolic reflector headphone design.

Figure 7:
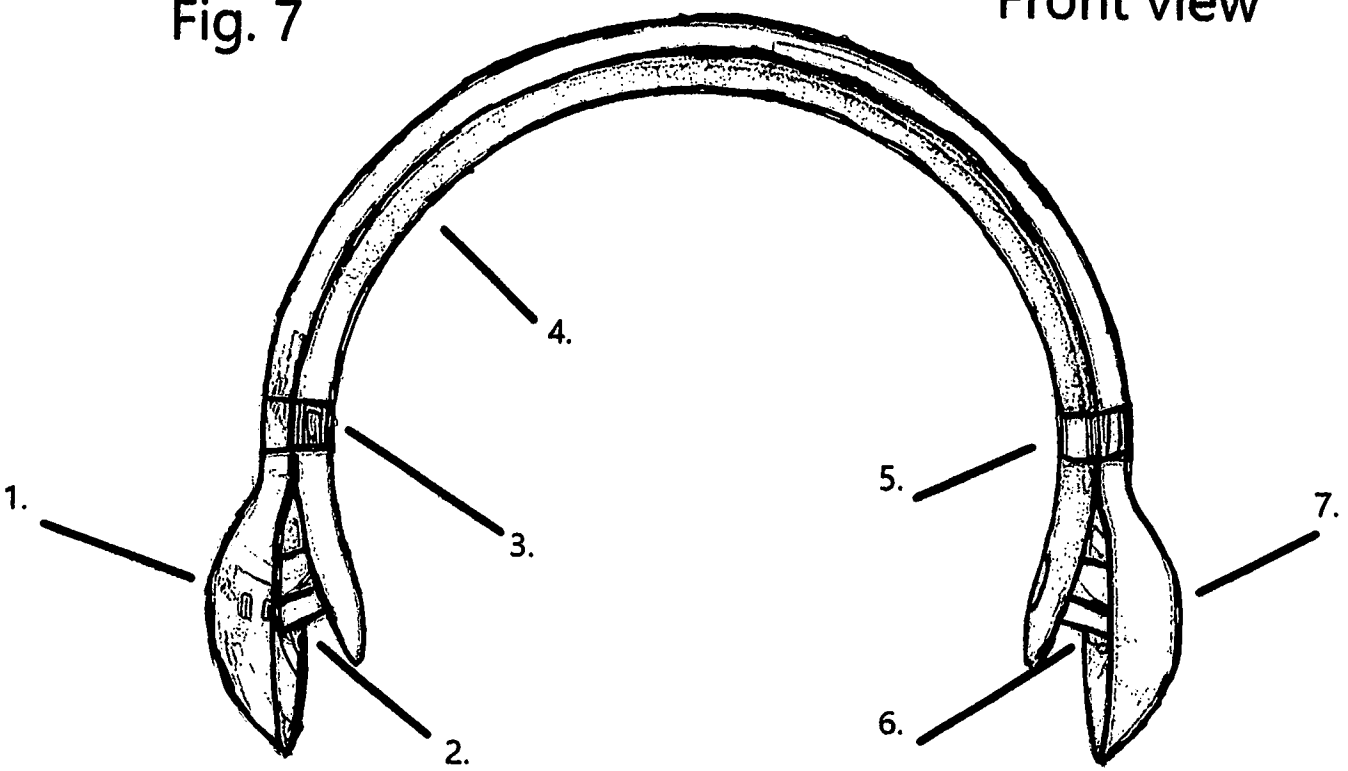

1. Acoustic reflector
2. Headband stretching mechanism
3. Headband
4. Headband stretching mechanism
5. Acoustic reflector FIG. 7 show a front view of the parabolic reflector headphone design.

1. Acoustic reflector
2. Speaker
3. Headband stretching mechanism
4. Headband
5. Headband stretching mechanism
6. Speaker
7. Acoustic reflector

DETAILED DESCRIPTION OF THE INVENTION

The invention is a directional audio headphone system based on reflecting focus audio into the ears. Three designs are described: Planar array configuration, mini sound dome configuration and parabolic reflector configuration. Design variation can also be in the speakers where it can use ultrasound speaker or general direction speakers. The general direction speakers will have a mini sound dome or parabolic reflector attached to it to focus the sound back into the user's ear for personal audio listening.

The ultrasound headphone design can have one transducer (for each ear) pointed up (or any speaker) and a half dome (or any reflective structure) can reflect the sound down into the user's ears like in the image below. The overall concept is to separate the headphone speaker from the user's ear and bounce the sound into the ear canals so there is no need for ear pads or ear plugs. This design will have better sound quality than bone conduction or other open ear headphone designs and possibility traditional in the ear or over the ear headphones.

Reflectors bounce the ultrasound audio down to the ears so the user can enjoy directional, private high quality audio without needing uncomfortable, hot and sweaty earpads The reflective part of the directional speakers can be any shape as long as it directs the audio to the user's ears. The headphone can have one transducer (for each ear) pointed up (or any speaker) and a half dome (or any reflective structure) can reflect the sound down like. The overall concept is to separate the speaker from the user's ear and bounce sound into the ear canals so not need for ear pads or ear plugs. This design will have better sound quality than bone conduction or other open ear headphones.

In a different design variant the directional headphone design can have one transducer or any a general directional speaker (for each ear) mounted to the headband and pointed up where reflectors, reflect the sound down into the user's ears for private audio listening without the need for having earpads on the ear or earbuds in the ear. The overall concept is to separate the headphone speaker from the user's ear and bounce the sound into the ears canals so there is no need for ear pads or ear plugs. This design will have better sound quality than bone conduction or other open ear headphone designs and possibility traditional in the ear or over the ear headphones.

Normally sound domes are hanging from ceilings. They beam directional audio to people directly underneath. The same concept applies to these new ultrasonic headphones. It beams precise planar audio upward and a reflective surface bounces the audio down to the user's ears. This open ear headphone design will be superior to open ear bone conduction headphones in terms of comfort and audio quality.

The reflector not only reflect sound but it is also directing high pressure sound waves from the ultrasonic transducers. Actually, the ultrasonic speakers creates concentrated high pressure sound waves. That is why the transducers aren't pointed directly towards the ears. The direct sound waves are reflected off the curved surface so the ears aren't hit with pressure from the laser like sound waves. It's possible to configure the geometry of the reflectors to not only direct sound to the ears but control the sound wave pressure from the transducer speakers to achieve the desire bass level.

Direct ultrasound can hurt at close range due to the sound pressure waves. However, using the novel ultrasonic headphone design the direct ultrasonic audio waves will bounce off the reflective material so the user can hear gentle low pressure private directional audio without the need to use earpad headphones or plug-in ear phones). This new ultrasonic open ear design is far superior to the open ear bone conduction headphone design.

"Above from ear" parametric headphone speakers directs ultrasonic audio speakers upward. Rather than hitting the user with direct ultrasonic sound pressure waves the waves are bounced off the curved inner wall so the sound pressure can lower and the audio can gently go into the user's ear for private music listening. This novel design can be a great alternative to padded earphones and plug-in earphones. These next-gen headphones and earphones will revolutionize the personal audio system.

There are different Open ear Headphones. Bone conduction don't deliver the high quality desired. For other open ear design that wrap around the ear they'll feel uncomfortable after a while. Whether in the ear, on the ear or wrapped around the ear the weight or contact with things on the ear can feel uncomfortable and irritating.

The ultrasonic Headphones offers the perfect solution. That is having Headphones that ever touches the ears and deliver high quality audio from a acoustic laser source.

For safety the inner walls and base of the ultrasonic speaker box container can have sound absorbent material. This will just be a safety precaution to prevent any ultrasonic waves from leaking laterally or down into the user. All the waves will point up and go as directed within the reflective headphone apparatus.

Future variants come in a neck arm versions to compliment the Head arm. The idea is that the "above the ear" headphones never goes in the ear (ear-plugs) or on the ear (ear pads).

The ultra sonic headphones can also include 3D sound technology in future models for true next-gen open ear music experiences.

In closing using directional audio for traditional in the ear or over the ear headphones isn't novel or useful. Why use directional speakers for headphones if the speakers are already in the ear or around them? Laterally positioning the speakers a air gap distance away can be unhealthy because of the high pressure sound waves from the ultra sound. The novel and safe use of directional audio on headphones is to have a above the ear and open ear design to beam and reflect audio into the ears for comfort (no ear pads required) and external situational awareness for when the user is in public places.

The individual speakers can be positioned at a 45 or 90 or 180 degree angle so all the ultrasound waves point in the same direction on the reflector so they can be focused into the user ears for private audio listening use. The geometry of the reflector can be any shape as so long as it focus the private audio into the ear and to achieve the maximum bass for the listening. Also, if transducers are used then the reflectors can be designed in such a way to direct the pressure of the ultrasound away that are generated by transducers. To be as useful to the listener the directional personal headphone system can have a Head arm or neck arm or ear hooks to mount the speakers and reflective materials on. For more comfort the directional headphone can expand or contract via a mechanism to adjust to the width of the head of the user.

In a planar array configuration the speakers placed above each ear of the headphone system can be adjusted to swivel and point down vertically where the ultrasound hits the top of the ear and flow around the ear and produce audio sound for the user were the reflected part can be adjusted to move out of the way as the ultrasonic beam point downward directly over the ears.

Some users may prefer 3D sound effects so the individual speakers on the ultrasonic headphone can be positioned to reflect at different angles to achieve a 3D sound effect for the user.

To prevent sound leakage the reflective sound material on the headphone system can have embedded sensors and displays and intelligent controls were the user can control music through by voice commands or swipe gestures.

For more options for the listeners the directional speaker headphone system can be wired or wireless or have Bluetooth wireless connectivity. Just in case if the user drops in water or in the rain the ultrasonic headphone system is water resistant. For practicality the ultrasonic headphone system has the volume control buttons and 3.5 mm input jack or a different of type audio input connector and the audio electronic processors one side of the headphone system and the power button and power cord input and battery on the other side of the headphone system.

To provide more information on the status of the battery of the headphone system or information about the audio music tracks the reflectors on the directional headphones can be made of flexible or bendable transparent or non-transparent displays where the displays can give the battery charge level of the headphone to keep the user inform of the battery level and can give a series of colors to display when the battery is low to let the user know it's time to recharge the battery and a physical switch on the headphone or app settings can keep the display off or on as needed.

The design of the directional speaker can take different configurations: Parabolic reflector design, sound down and Planar array configuration. The sound reflector on the headphone speaker can have a parabolic shape or Planar array arc to focus sound towards the ears were a mechanism can pivot the speakers and parabolic or Planar array reflector to best focus sound into the user's ears. The directional speaker and acoustic reflectors can also be used on a neck band where the directional speakers and acoustic reflectors direct sound upward towards the ears for private audio listening and the sound reflectors can pivot so they can be adjusted by the user to best direct sound into the user's ears.

A sideways parabolic dome speaker can hang on the side of each ear connected to a headband or neck band where the acoustic emitter attached to the headphone band can laterally direct sound into the parabolic mini sound domes and then the sound dome reflect and focus sound back into the ears for the private sound audio and bass. A level of noise cancellation technology can be incorporated into the directional speaker headphone design. A parabolic sound dome or reflector planar array headphone system can have an array of secondary audio speaker around the central main speakers to cancel external noise. To increase the audio quality of the new directional headphone system a parabolic sound dome or reflector planar array headphone system with adaptive audio that uses processors to customize the sound for the user's ears.

What is claimed is:

1. An ultrasound headphone system comprising:

a headphone headband;

a first ultrasound speaker attached to a first end of the headphone headband and configured to output a first directional ultrasound away from a user's first ear;

a second ultrasound speaker attached to a second end of the headphone headband and configured to output a second directional ultrasound away from the user's second ear;

a first curved reflector attached to the first end of the headphone headband and configured to reflect and focus the first directional ultrasound to the user's first ear canal; and a second curved reflector attached to the second end of the headphone headband and configured to reflect and focus the second directional ultrasound to the user's second ear canal.

* * * * *